US011365460B2

(12) United States Patent
Miyamoto et al.

(10) Patent No.: US 11,365,460 B2
(45) Date of Patent: Jun. 21, 2022

(54) HIGH-CARBON COLD ROLLED STEEL SHEET AND METHOD FOR MANUFACTURING SAME

(71) Applicant: JFE STEEL CORPORATION, Tokyo (JP)

(72) Inventors: Yuka Miyamoto, Tokyo (JP); Yoichiro Matsui, Tokyo (JP); Shogo Sato, Tokyo (JP); Takeshi Yokota, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 132 days.

(21) Appl. No.: 16/971,719

(22) PCT Filed: Feb. 20, 2019

(86) PCT No.: PCT/JP2019/006328
§ 371 (c)(1),
(2) Date: Aug. 21, 2020

(87) PCT Pub. No.: WO2019/163828
PCT Pub. Date: Aug. 29, 2019

(65) Prior Publication Data

US 2020/0392600 A1 Dec. 17, 2020

(30) Foreign Application Priority Data

Feb. 23, 2018 (JP) ..... JP2018-030254

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0205* (2013.01); *C21D 8/0226* (2013.01);
(Continued)

(58) Field of Classification Search
None
See application file for complete search history.

(56) References Cited

U.S. PATENT DOCUMENTS

2009/0173415 A1* 7/2009 Seto ..... C21D 1/18 148/333
2014/0241934 A1 8/2014 Morohoshi et al.
(Continued)

FOREIGN PATENT DOCUMENTS

CN 101379207 A 3/2009
CN 101379208 A 3/2009
(Continued)

OTHER PUBLICATIONS

Apr. 30, 2021 Office Action issued in Chinese Patent Application No. 201980014773.6.
(Continued)

*Primary Examiner* — Xiaowei Su
(74) *Attorney, Agent, or Firm* — Oliff PLC

(57) ABSTRACT

A high-carbon cold rolled steel sheet having a specified chemical composition, and a method for manufacturing the same. The method includes forming a hot rolled steel sheet, performing cooling at an average cooling rate of 30° C./s or more and 70° C./s or less through a temperature range of a finish rolling end temperature to 660° C., coiling a hot rolled steel sheet at a temperature of 500° C. or more and 660° C. or less, and, optionally, pickling the coiled hot rolled steel sheet, and then performing a first box-annealing of holding at an annealing temperature in a temperature range of 650 to 720° C., then performing cold rolling at a rolling reduction ratio of 20 to 50%, and then performing a second box-annealing of holding at an annealing temperature in a temperature range of 650 to 720° C.

4 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |
| ***C23G 1/00*** | (2006.01) |

(52) U.S. Cl.
CPC ..... *C21D 8/0236* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/18* (2013.01); *C23G 1/00* (2013.01); *C21D 2211/003* (2013.01); *C21D 2211/005* (2013.01)

(56) References Cited

U.S. PATENT DOCUMENTS

| | | | | |
|---|---|---|---|---|
| 2015/0275339 | A1* | 10/2015 | Aratani | C22C 38/02 148/330 |
| 2016/0289787 | A1* | 10/2016 | Takeda | C21D 8/0273 |

FOREIGN PATENT DOCUMENTS

| | | | |
|---|---|---|---|
| CN | 102021491 | A | 4/2011 |
| CN | 103014493 | A | 4/2013 |
| CN | 105745348 | A | 7/2016 |
| EP | 1980635 | A1 | 10/2008 |
| EP | 2003220 | A1 | 12/2008 |
| EP | 3072987 | A1 | 9/2016 |
| JP | H11-264049 | A | 9/1999 |
| JP | 2000-34542 | A | 2/2000 |
| JP | 2006-274328 | A | 10/2006 |
| JP | 2006-274348 | A | 10/2006 |
| JP | 2007-31761 | A | 2/2007 |
| JP | 2007-31762 | A | 2/2007 |
| JP | 2007-231416 | A | 9/2007 |
| JP | 2007-270328 | A | 10/2007 |
| JP | 2007-270331 | A | 10/2007 |
| JP | 2009-24233 | A | 2/2009 |
| JP | 2010-235965 | A | 10/2010 |
| JP | 2015-117406 | A | 6/2015 |
| JP | 2016-222990 | A | 12/2016 |
| JP | 2017-179596 | A | 10/2017 |
| WO | 2015020028 | A1 | 2/2015 |

OTHER PUBLICATIONS

May 28, 2019 International Search Report issued in International Patent Application No. PCT/JP2019/006328.

Dec. 7, 2020 Extended European Search Report issued in European Application No. 19757378.5.

* cited by examiner

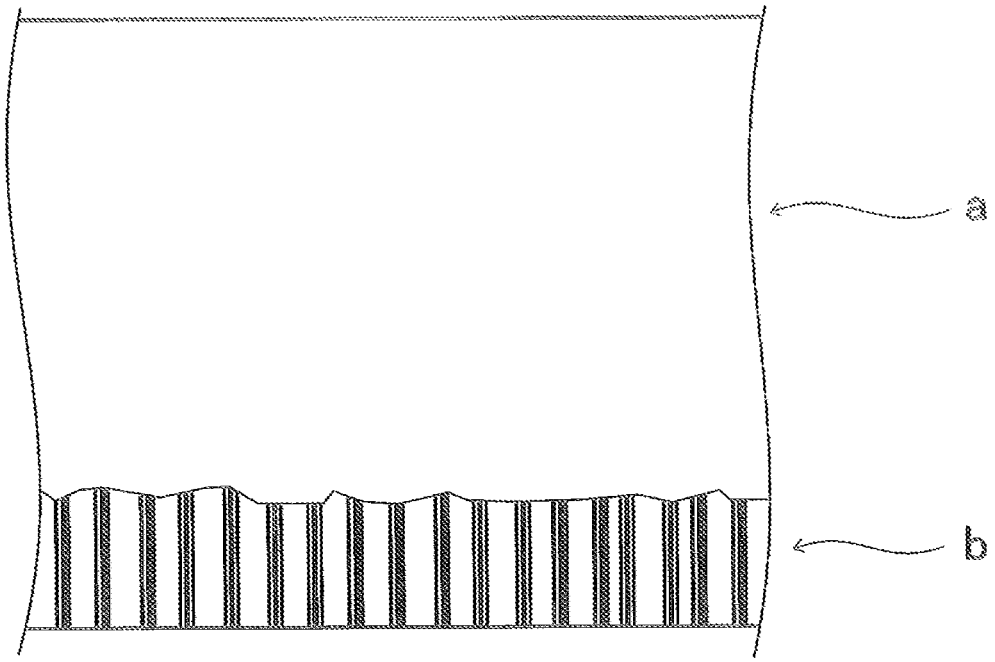
a
b

HIGH-CARBON COLD ROLLED STEEL SHEET AND METHOD FOR MANUFACTURING SAME

TECHNICAL FIELD

This application relates to a high-carbon cold rolled steel sheet and a method for manufacturing the same, and relates particularly to a high-carbon cold rolled steel sheet excellent in fine blanking performance that provides an end surface with a reduced area of a fracture surface, which is a cause of fatigue life, during fine blanking processing, which is suitable as the material processing of automotive parts, chain parts, etc., and that hinders a die unit from wearing away, and a method for manufacturing the same.

BACKGROUND

There are cases where high-carbon cold rolled steel sheets are used as materials for automotive driving system parts and chain parts. Automotive driving system parts and chain parts are often manufactured by fine blanking processing in order to obtain a punched end surface having a smooth shape; on the other hand, fine blanking processing is a processing method with a small clearance, and hence a high load is applied to a die unit, particularly a high burden is applied to a blanking punch; thus, the life of the die unit affected by the wear of the punch, etc. as a cause is an issue. Further, a high-carbon cold rolled steel sheet used as a material of these parts is caused to contain a certain level or more of carbon in order to obtain a predetermined hardness after heat treatment. By being subjected to heat treatment such as quenching and tempering, the high-carbon cold rolled steel sheet with a high content amount of C obtains an increased strength and an improved fatigue life.

Since the content amount of C of the high-carbon cold rolled steel sheet is high, carbon in the steel is precipitated as hard cementite, and the amount of cementite is large; hence, in a hot-rolled state as it is, the high-carbon cold rolled steel sheet is hard to process. Thus, the high-carbon cold rolled steel sheet is usually used after being subjected to annealing after hot rolling to spheroidize and moderately disperse cementite to improve processability.

Fine blanking processing that is dealt with in the disclosed embodiments will now be described using FIG. 1. The fine blanking processing dealt with by the disclosed embodiments refers to fine blanking processing that uses a high-carbon steel sheet as a material and uses a die unit and a punch to perform processing with a clearance of 25 μm or less. FIG. 1 is a conceptual diagram showing a punched end surface after fine blanking processing. Hereinafter, in the present description, the punched end surface is also referred to as simply an "end surface". The end surface after fine blanking processing is usually composed of a shear surface ("a" in FIG. 1) generated by smooth cutting based on plastic deformation through contact with a cutting edge and a fracture surface ("b" in FIG. 1) generated when cracks occur and the material is separated. In order to ensure a predetermined fatigue life after heat treatment, it is desirable to suppress the fracture surface having a large roughness of the end surface as much as possible, and it is necessary to reduce the surface roughness of the shear surface. Further, since fine blanking processing is a processing method with a small clearance, a high load is applied to a die unit, particularly a high burden is applied to a blanking punch; thus, the life of the die unit is shorter than in ordinary punching. Also to prolong the life of the die unit, it is desirable that the surface roughness of the shear surface be smaller.

The life of the die unit is shortened if the ductility of the steel sheet is either too high or too low. For example, if excessive softening is made during annealing of cementite spheroidizing, although the fluidity of the steel sheet during blanking processing (punching) works favorably, due to the excessively good fluidity the steel sheet comes into contact with the punch excessively, and the wear of the punch is increased and the life of the punch is reduced. On the other hand, if the spheroidizing of cementite is insufficient during annealing and the steel sheet is too hard, wear loss of the punch, etc. occur, and the life of the punch is reduced all the same. Thus, cases where a high-carbon cold rolled steel sheet used for blanking processing is subjected to annealing after hot rolling to spheroidize cementite and is then subjected to cold rolling to adjust the hardness so that the full width and the full length including the lengthwise direction and the widthwise direction become a region with a proper hardness are often seen.

For example, Patent Literature 1 proposes a method of manufacturing a high-carbon steel strip in which steel containing, in mass %, C: 0.20 to 0.80%, Si: 0.3% or less, Mn: 0.60 to 1.60%, sol. Al: 0.010 to 0.100%, and Ca: 0.0100% or less is hot rolled and is coiled at 550 to 680° C., is pickled, is then subjected to a first cold rolling at a rolling reduction ratio of 10 to 80%, intermediate annealing at 650 to 725° C., and then a second cold rolling at a rolling reduction ratio of 5 to 25%, and is used as a product without being subjected to heat treatment thereafter.

Patent Literature 2 proposes a middle-and-high-carbon hot rolled steel sheet excellent in punchability that contains, in mass %, C: 0.10 to 0.70%, Si: 0.01 to 1.0%, Mn: 0.1 to 3.0%, P: 0.001 to 0.025%, S: 0.0001 to 0.010%, Al: 0.001 to 0.10%, and N: 0.001 to 0.01%, has a microstructure in which a ferrite grain diameter is 10 μm or more and 50 μm or less, a grain size of cementite is 0.1 μm or more and 2.0 μm or less, and a spheroidizing ratio of cementite is 85% or more, and has a hardness HV of 100 or more and 160 or less.

Patent Literature 3 proposes a method of manufacturing a high-carbon steel strip excellent in cold workability and fatigue life after heat treatment that contains, in weight %, C: 0.20 to 1.20%, Si: 0.05 to 0.30%, and P: less than 0.020%, the manufacturing method including, after hot rolling, performing cold rolling at 20 to 80% and annealing at 650 to 720° C. once or repeating them twice or more.

Patent Literature 4 proposes a steel sheet excellent in bending processability and punching processability that contains, in mass %, C: 0.25 to 0.6%, Si: 2% or less, Mn: 2% or less, P: 0.02% or less, S: 0.02% or less, Cr: 2% or less, and V: 0.05 to 0.5% and has a hardness HV of 180 or more and 350 or less.

Patent Literature 5 proposes a high-carbon steel sheet excellent in processability that contains, in mass %, C: 0.45 to 0.90%, Si: 0.001 to 0.5% or less, Mn: 0.2 to 2.0%, P: 0.03% or less, S: 0.005% or less, Al: 0.001 to 0.10%, and N: 0.01% or less, further contains one or more selected from the group consisting of Cr: 0.005 to 1.0%, Mo: 0.005 to 1.0%, Cu: 0.005 to 1.0%, Ni: 0.005 to 1.0%, Ti: 0.005 to 0.3%, Nb: 0.005 to 0.3%, V: 0.005 to 0.3%, B: 0.0005 to 0.01%, and Ca: 0.0005 to 0.01%, has a hardness HV of 150 or less, and has a hardness difference ΔHVt between a portion extending t/2 and a portion extending t/4 in depth (t: thickness of steel sheet) of 10 or less.

Patent Literature 6 proposes a steel sheet excellent in fine blanking performance that contains, in mass %, C: 0.1 to 0.5%, Si: 0.5% or less, Mn: 0.2 to 1.5%, P: 0.03% or less, and S: 0.02% or less, further contains Al: 0.1% or less as necessary, and further contains one or two or more selected from Cr: 3.5% or less, Mo: 0.7% or less, Ni: 3.5% or less, Ti: 0.01 to 0.1%, and B: 0.0005 to 0.005% and in which an average size of ferrite grain is 1 to 20 μm, ferrite grains having aspect ratios of 2 or less account for 70% or more in terms of an area fraction to the total amount of ferrite, a spheroidizing ratio of carbides is 90% or more, and an amount of ferrite grain boundary carbides is 40% or more.

Patent Literature 7 proposes a steel sheet excellent in fine blanking performance that contains, in mass %, C: 0.1 to 0.5%, Si: 0.5% or less, Mn: 0.2 to 1.5%, P: 0.03% or less, and S: 0.02% or less, further contains Al: 0.1% or less as necessary, and further contains one or two or more selected from among Cr: 3.5% or less, Mo: 0.7% or less, Ni: 3.5% or less, Ti: 0.01 to 0.1%, and B: 0.0005 to 0.005% and in which an average size of ferrite grain is 1 to 10 μm, a spheroidizing ratio of carbides is 80% or more, and an amount of ferrite grain boundary carbides is 40% or more.

Patent Literature 8 proposes a high-carbon steel sheet excellent in stretch formability that contains, in mass %, C: 0.65 to 0.90%, Si: 0.01 to 0.50% or less, Mn: 0.1 to 2.00%, P: 0.0200% or less, S: 0.0200% or less, and Cr: 0.20 to 2.00% and further contains, as necessary, one or two or more of Al, Mo, Ni, Cu, B, Nb, V, Ti, W, Ta, Mg, Ca, Y, Zr, La, Ce, N, O, Sn, Sb, and As and in which a spheroidizing ratio defined by the number ratio of carbide grains having aspect ratios of less than 3 is 80 to 99%, the mean particle diameter converted to a equivalent circle diameter is 0.2 to 1.5 μm, and carbide grains are distributed such that the standard deviation σ of the sizes of carbide grains is 0.10 to 0.45.

CITATION LIST

Patent Literature

Patent Literature 1: JP 11-264049 A
Patent Literature 2: JP 2015-117406 A
Patent Literature 3: JP 2000-34542 A
Patent Literature 4: JP 2010-235965 A
Patent Literature 5: JP 2017-179596 A
Patent Literature 6: JP 2007-270331 A
Patent Literature 7: JP 2007-231416 A
Patent Literature 8: JP 2016-222990 A

SUMMARY

Technical Problem

Patent Literature 1 proposes a high-carbon steel strip with which an end surface in which an area of a fracture surface in punching is reduced as much as possible is obtained by setting the spheroidizing ratio of cementite in the steel to 80% or more, a mean particle diameter to 0.8 μm or less, and a tensile strength of the steel to 600 to 700 N/mm$^2$; the high-carbon steel strip is manufactured by, after performing hot rolling and pickling, performing a first cold rolling, annealing, and a second cold rolling. However, Patent Literature 1 does not describe a manufacturing method in which a hot rolled steel sheet coiled after hot rolling is, as it is or after pickled, subjected to a first box annealing, cold rolling, and a second box annealing, and does not discuss steel with a hardness of a tensile strength of less than 600 N/mm$^2$; thus, the high-carbon steel strip disclosed in Patent Literature 1 does not provide sufficient cold workability.

The middle-and-high-carbon hot rolled steel sheet described in Patent Literature 2 has a hardness HV of steel of 100 or more and 160 or less, and is excellent in cold workability; however, Patent Literature 2 is a technology regarding a hot rolled steel sheet having a thickness of 3.5 mm or more and is different in technology from the cold rolled steel sheet dealt with in the disclosed embodiments, and has no description regarding cold rolling or annealing before or after it.

In Patent Literature 3, a method of manufacturing a high-carbon steel strip excellent in cold workability and fatigue life after heat treatment is proposed, and predetermined processability is obtained by adjusting compositions of steel and conditions of cold rolling and annealing after hot rolling; however, there is no description regarding hot rolling, and no description regarding a grain size of cementite or ferrite, either.

In Patent Literature 4, a steel sheet excellent in bending processability and punching processability is proposed; however, the steel is caused to contain Cr at 0.61% or more in order to increase tempering softening resistance, and there is no description regarding steel having an addition amount of Cr of less than 0.61%.

In Patent Literature 5, also a chain is taken as a target use; hence, it is inferred that also fine blanking performance is taken into consideration as required processability. However, in Patent Literature 5, an adjustment of microstructure and hardness is made only by an annealing step after hot rolling, and there is no description regarding a cold rolling step.

In Patent Literature 6, a cold rolled steel sheet excellent in fine blanking performance is proposed; for the microstructure of a base material, a ferrite grain diameter, a spheroidizing ratio of carbide, an amount of carbides at ferrite grain boundaries, etc. are prescribed, and it is mentioned that these factors influence a Rz of a punched end surface, which serves as an index of fine blanking performance; however, there is no description regarding an average spacing between carbide grains or an influence of it on fine blanking processing. Further, there is no description regarding an amount of Cr for obtaining predetermined fine blanking performance, either.

In Patent Literature 7, a hot rolled steel sheet excellent in fine blanking performance is proposed; the technology is different from that of the cold rolled steel sheet dealt with in the disclosed embodiments, and there is no description regarding cold rolling or annealing before or after it.

In Patent Literature 8, a high-carbon steel sheet excellent in stretch formability is proposed; a method in which a second annealing after a first cold rolling is performed for 1800 seconds or less in a continuous annealing furnace is described, but a method of performing a second annealing by box annealing is not described. Further, an index of fine blanking performance is not described, either.

An object of the disclosed embodiments is to provide a high-carbon cold rolled steel sheet excellent in fine blanking performance and a method for manufacturing the same.

Specifically, an object of the disclosed embodiments is to provide a high-carbon cold rolled steel sheet excellent in fine blanking performance that has a microstructure in which a mean particle diameter of cementite is 0.40 μm or more and 0.75 μm or less, an average spacing between cementite grains is 1.5 μm or more and 8.0 μm or less, the spheroidizing ratio of cementite is 75% or more, and an average size of ferrite grain is 4.0 μm or more and 10.0 μm or less and in which a shear surface ratio of a punched end surface after performing blanking processing using a die unit with a clearance between a blanking punch and a die set to 25 μm or less is 90% or more and the arithmetic average roughness Ra of the shear surface of the punched end surface is less than 1.0 μm, by a method in which a steel material containing 0.10% or more and less than 0.40% Cr is subjected to a first box-annealing, cold rolling, and a second box-annealing to manufacture a cold rolled steel sheet by using a predetermined finish rolling end temperature, a predetermined average rate of cooling until coiling, and a predetermined coiling temperature, and a method for manufacturing the same.

Note that in the present description, the high-carbon cold rolled steel sheet refers to a cold rolled steel sheet in which a content amount of C is 0.45 mass % or more. Further, in the description, the cold rolled steel sheet excellent in fine blanking performance is a cold rolled steel sheet in which a shear surface ratio of a punched end surface after performing fine blanking processing using a die unit with a clearance between a blanking punch and a die set to 25 μm or less is 90% or more, and an arithmetic average roughness Ra of a shear surface of the punched end surface is less than 1.0 μm.

Solution to Problem

The present inventors conducted extensive studies on relationships between a finish rolling end temperature, a rate of cooling until coiling, a coiling temperature, a temperature of a first annealing, a rolling reduction ratio of cold rolling, and a temperature of a second annealing of steel containing 0.10% or more and less than 0.40% Cr, and fine blanking performance.

As a result, the present inventors have obtained findings that the fine blanking performance of a high-carbon cold rolled steel sheet is greatly influenced by the mean particle diameter of cementite, the spheroidizing ratio of cementite, and the average size of ferrite grain in the steel microstructure and that a shear surface ratio of an end surface after fine blanking processing of 90% or more and an arithmetic average roughness Ra of the shear surface of less than 1.0 μm are obtained by setting the mean particle diameter of cementite to 0.40 μm or more and 0.75 μm or less, the average spacing between cementite grains to 1.5 μm or more and 8.0 μm or less, the spheroidizing ratio of cementite to 75% or more, and the average size of ferrite grain to 4.0 μm or more and 10.0 μm or less.

The disclosed embodiments have been completed on the basis of the findings described above, and the subject matter of the disclosed embodiments is as follows.

[1] A high-carbon cold rolled steel sheet including a composition containing, in mass %, C: 0.45 to 0.75%,
Si: 0.10 to 0.50%,
Mn: 0.50 to 1.00%,
P: 0.03% or less,
S: 0.01% or less,
sol. Al: 0.10% or less,
N: 0.0150% or less,
Cr: 0.10% or more and less than 0.40%, and
the balance being Fe and incidental impurities, and a microstructure in which a mean particle diameter of cementite is 0.40 μm or more and 0.75 μm or less, an average spacing between cementite grains is 1.5 μm or more and 8.0 μm or less, a spheroidizing ratio of cementite is 75% or more, and an average size of ferrite grain is 4.0 μm or more and 10.0 μm or less, in which a shear surface ratio of a punched end surface after performing fine blanking processing using a die unit with a clearance between a blanking punch and a die set to 25 μm or less is 90% or more, and an arithmetic average roughness Ra of a shear surface of the punched end surface is less than 1.0 μm.

[2] The high-carbon cold rolled steel sheet according to [1], in which a cross-sectional hardness is an HV 160 or less.

[3] A method for manufacturing the high-carbon cold rolled steel sheet according to [1] or [2], the method including:

directly heating a cast piece having the composition or temporarily cooling and reheating the cast piece, and then performing rough rolling;

performing, after the rough rolling is ended, finish rolling that is ended in a temperature region of an $Ar_3$ transformation point or higher;

performing cooling at an average cooling rate of 30° C./s or more and 70° C./s or less through a temperature region from a finish rolling end temperature to 660° C., coiling a hot rolled steel sheet at 500° C. or more and 660° C. or less, and using the coiled hot rolled steel sheet as it is or pickling the coiled hot rolled steel sheet; and then performing a first box-annealing of holding at an annealing temperature in a temperature region of 650 to 720° C., then performing cold rolling at a rolling reduction ratio of 20 to 50%, and then performing a second box-annealing of holding at an annealing temperature in a temperature region of 650 to 720° C.

Advantageous Effects

According to the disclosed embodiments, a high-carbon cold rolled steel sheet excellent in fine blanking performance can be provided.

A high-carbon cold rolled steel sheet of the disclosed embodiments is suitable as materials for automotive parts and chain parts in which fine blanking performance is required of steel sheets as materials, and is particularly suitable as materials for automotive driving system parts such as timing chains.

BRIEF DESCRIPTION OF THE DRAWINGS

FIG. 1 is a conceptual diagram showing a punched end surface after fine blanking processing.

DETAILED DESCRIPTION

Hereafter, a high-carbon cold rolled steel sheet and a method for manufacturing the same according to the disclosed embodiments will be described in detail. Here, when the content amount of the composition is expressed in units of %, "%" refers to "mass %", unless otherwise noted.

1) Composition

C: 0.45 to 0.75%

C is an element important for obtaining the strength after quenching. In the case where the content amount of C is less than 0.45%, a desired hardness is not obtained by heat treatment such as quenching or tempering after the steel sheet is processed into a component; thus, the content amount of C needs to be set to 0.45% or more. However, if the content amount of C is more than 0.75%, hardening is made, and toughness and cold workability such as fine blanking performance are degraded. Thus, the content amount of C is set to 0.45 to 0.75%. To obtain a superior hardness after quenching, the content amount of C is preferably set to 0.50% or more, more preferably set to 0.51% or more, and still more preferably set to 0.53% or more. Further, in the case of use for processing of a component that requires severe processability, that is, a component that requires a high degree of processing and is hard to form, the content amount of C is preferably set to 0.70% or less, more preferably set to 0.67% or less, and still more preferably set to 0.65% or less.

Si: 0.10 to 0.50%

Si is added as a deoxidizer along with Al when refining the steel. However, if Si is incorporated excessively, Si oxides are generated at grain boundaries during heat treatment, and a fear of reducing fatigue strength is increased. Thus, the content amount of Si is set to 0.50% or less. The content amount of Si is preferably 0.45% or less, more preferably 0.40% or less, and still more preferably 0.35% or less. On the other hand, Si is an element that increases tempering softening resistance after heat treatment. To obtain a desired hardness even when tempering is performed in a wide temperature region after quenching, the content amount of Si is set to 0.10% or more. The content amount of Si is preferably 0.15% or more, and more preferably 0.16% or more.

Mn: 0.50 to 1.00%

Mn is an element to enhance strength on the basis of solid solution strengthening in addition to enhance the hardenability. If the content amount of Mn is more than 1.00%, a band texture derived from the segregation of Mn develops and the microstructure is made non-uniform, and furthermore the steel is hardened and cold workability is reduced due to solid solution strengthening. Thus, the content amount of Mn is set to 1.00% or less. The content amount of Mn is preferably 0.95% or less, more preferably 0.90% or less, and still more preferably 0.85% or less. On the other hand, at less than 0.50%, immersion hardenability begins to decrease; thus, the content amount of Mn is set to 0.50% or more. The content amount of Mn is preferably 0.52% or more, and more preferably 0.55% or more.

P: 0.03% or Less

P is a chemical element which increases strength through solid solution strengthening. In the case where the content amount of P is more than 0.03%, since grain boundary embrittlement occurs, there is a decrease in toughness after quenching has been performed. Therefore, the content amount of P is set to be 0.03% or less. It is preferable that the content amount of P be 0.02% or less in order to achieve excellent toughness after quenching has been performed. Since P decreases cold workability and after-quenching toughness, it is preferable that the content amount of P be as small as possible, however, since there is an increase in refining costs in the case where the P is excessively low, it is preferable that the content amount of P be 0.005% or more.

S: 0.01% or Less

S is a chemical element whose content must be decreased, because S decreases the cold workability and after-quenching toughness of a high-carbon cold rolled steel sheet as a result of forming sulfides. In the case where the content amount of S is more than 0.01%, there is a significant decrease in the cold workability and after-quenching toughness of a high-carbon cold rolled steel sheet. Therefore, the content amount of S is set to be 0.01% or less. To obtain a superior cold workability and after-quenching toughness, the content amount of S is preferably set to 0.004% or less, and more preferably 0.0040% or less. Since S decreases cold workability and after-quenching toughness, it is preferable that the content amount of S be as small as possible, however, since there is an increase in refining costs in the case where the S is excessively low, it is preferable that the content amount of S be 0.0005% or more.

Sol. Al: 0.10% or Less

In the case where the content amount of sol. Al is more than 0.10%, since the austenite grain becomes excessively small due to the formation of AlN when heating is performed for a quenching treatment, the microstructure is composed of ferrite and martensite because the formation of a ferrite phase is promoted when cooling is performed, which results in a decrease in hardness after quenching has been performed. Therefore, the content amount of sol. Al is set to be 0.10% or less. The content amount of sol. Al is preferably 0.06% or less. Here, since sol. Al is effective for deoxidation, to realize sufficient deoxidation, the content amount of sol. Al is preferably set to 0.005% or more, more preferably set to 0.010% or more, and still more preferably set to 0.015% or more.

N: 0.0150% or Less

In the case where the content amount of N is more than 0.0150%, since the austenite grain becomes excessively small due to the formation of AlN when heating is performed for a quenching treatment, the formation of a ferrite phase is promoted when cooling is performed, which results in a decrease in hardness after quenching has been performed. Therefore, the content amount of N is set to be 0.0150% or less. Note that there is no particular limitation on the lower limit of the content amount of N, however, N is a chemical element which increases toughness after quenching has been performed by appropriately inhibiting austenite grain growth when heating is performed for a quenching treatment as a result of forming AlN and Cr-based nitride, it is preferable that the content amount of N be 0.0005% or more.

Cr: 0.10% or More and Less than 0.40%

Cr is an element that delays the spheroidizing of cementite in the steel, and is an important element that enhances hardenability in heat treatment. In the case of less than 0.10%, the spheroidizing of cementite progresses excessively, and a predetermined mean particle diameter of cementite is not obtained; further, for hardenability, ferrite is likely to be generated during quenching, and a sufficient effect is not seen; thus, the content amount of Cr is set to be 0.10% or more. On the other hand, if the content amount of Cr is 0.40% or more, the spheroidizing of cementite is less likely to progress, and a predetermined spheroidizing ratio of cementite is not obtained. As a result, the steel sheet before quenching is hardened, and a predetermined average spacing between cementite grains is not obtained; for example, when fine blanking processing is performed, a fracture surface is likely to occur in the end surface, and the surface roughness Ra of the shear surface of the end surface is likely to be increased. Thus, the content amount of Cr is set to be less than 0.40%. In particular, when processing a component in which a surface roughness Ra of the shear surface of the end surface is likely to occur or a fracture surface is likely to occur in the end surface, even more excellent processability is needed, and thus the content amount of Cr is preferably 0.35% or less.

Compositions other than those described above are Fe and incidental impurities. Further, in the case where scrap is used as a raw material of the high-carbon cold rolled steel sheet of the disclosed embodiments, there is a case where one or two or more of Sn, Sb, and, As are incidentally mixed in at 0.003% or more; however, each of these elements, when it is at 0.02% or less, does not inhibit the hardenability of the high-carbon cold rolled steel sheet of the disclosed embodiments; thus, the containing of one or two or more of Sn: 0.003 to 0.02%, Sb: 0.003 to 0.02%, and As: 0.003 to 0.02% is permitted as incidental impurities in the high-carbon cold rolled steel sheet of the disclosed embodiments.

2) Microstructure

The high-carbon cold rolled steel sheet of the disclosed embodiments has a microstructure containing ferrite and cementite. In the microstructure of the high-carbon cold rolled steel sheet of the disclosed embodiments, the total amount of ferrite and cementite is 95% or more in terms of area fraction. The total amount of ferrite and cementite is preferably 97% or more and may be 100% in terms of area fraction. The balance in the case where the total area fraction of ferrite and cementite is less than 100% is one or two selected from pearlite and bainite.

2-1) Mean Particle Diameter of Cementite: 0.40 μm or More and 0.75 μm or Less

If cementite with a large grain size exists, the cementite is disintegrated during fine blanking processing, and a fracture surface occurs in the end surface from the disintegrated portion as a starting point; thus, the mean particle diameter of cementite is set to 0.75 μm or less. The mean particle diameter of cementite is preferably 0.73 μm or less, and more preferably 0.71 μm or less. On the other hand, if cementite is made too fine, the number of cementite grains with sizes of 0.1 μm or less is increased, the hardness of the steel is raised, and the area of the fracture surface is increased in the end surface during fine blanking processing; thus, the mean particle diameter of cementite is set to 0.40 μm or more. The mean particle diameter of cementite is preferably 0.42 μm or more, and more preferably 0.44 μm or more. The mean particle diameter is an average value found by a method in which a cross section parallel to the rolling direction of a test piece extracted from the center of the sheet width of the steel sheet is polished and corroded, then the circle-equivalent diameters of all the cementite grains that are detected in a position of ¼ of the strip gauge at a magnification of 2000 times using a scanning electron microscope are calculated.

2-2) Average Spacing Between Cementite Grains: 1.5 μm or More and 8.0 μm or Less In a position where large deformation during fine blanking processing is given, voids occur and grow between cementite grains on ferrite grain boundaries, and cracks are likely to occur. These cracks advance during forming processing after fine blanking processing, and a fracture surface occurs. If the average spacing between cementite grains is less than 1.5 μm, the number of starting points of voids is increased excessively and cracks are likely to occur, and the length of the fracture surface of the end surface is increased; hence, fine blanking performance is reduced. Thus, the average spacing between cementite grains is set to 1.5 μm or more. The average spacing between cementite grains is preferably 1.7 μm or more, and more preferably 2.0 μm or more. Further, if the average spacing between cementite grains is more than 8.0 μm, the cementite per grain is made too large and cracks are likely to occur, and a place where the length of the fracture surface of the end surface is increased occurs. Thus, the average spacing between cementite grains is set to 8.0 μm or less. The average spacing between cementite grains is preferably 7.7 μm or less, and more preferably 7.5 μm or less. The average spacing between cementite grains was found by a method in which a cross section parallel to the rolling direction of a test piece extracted from the center of the sheet width of the steel sheet (a position of ¼ of the strip gauge) was observed with a scanning electron microscope at a magnification of 2000 times, cementite and portions other than cementite were binarized using an image analysis software application of GIMP, the individual spacings between cementite grains were found using an analysis software application of Image-J, and the sum total of them was divided by the number of spacings counted.

2-3) Spheroidizing Ratio of Cementite: 75% or More

When cementite is spheroidized, the ductility of the steel is improved and processability is made good; thus, this is preferable. When the spheroidizing ratio of cementite is 75% or more, the occurrence of a fracture surface in the end surface during punching is significantly suppressed, and a predetermined shear surface ratio is likely to be obtained; thus, the spheroidizing ratio of cementite in the microstructure of the high-carbon cold rolled steel sheet of the disclosed embodiments is set to be 75% or more. The spheroidizing ratio of cementite is preferably 77% or more, and more preferably 80% or more. A method for finding the spheroidizing ratio of cementite in the disclosed embodiments is as follows. A cross section parallel to the rolling direction of a test piece extracted from the center of the sheet width of the steel sheet (a position of ¼ of the strip gauge) is observed with a scanning electron microscope at a magnification of 2000 times, cementite and portions other than cementite are binarized using an image analysis software application of GIMP, the area and the perimeter of each cementite grain are found using an analysis software application of Image-J, the circularity coefficient of each cementite grain is calculated by the following formula, and the average of the circularity coefficients is found and is taken as the spheroidizing ratio of cementite.

$$\text{Circularity coefficient}=4\pi\cdot\text{area}/(\text{perimeter})^2$$

2-4) Average Size of Ferrite Grain: 4.0 μm or More and 10.0 μm or Less

The average size of ferrite grain is a factor that greatly controls processability including the hardness and the fine blanking performance of the steel sheet. If the size of ferrite grain is small, the hardness of the steel sheet is raised due to the fining strengthening of the steel, and processability is reduced. To obtain a predetermined hardness and predetermined processability, the average size of ferrite grain is set to 4.0 μm or more. The average size of ferrite grain is preferably 5.0 μm or more. On the other hand, if the average size of ferrite grain is more than 10.0 μm, a shear droop is likely to occur in the end surface during fine blanking processing, and fine blanking performance is reduced. Thus, the average size of ferrite grain is set to 10.0 μm or less. The average size of ferrite grain is preferably 8.0 μm or less. The average size of ferrite grain was found using a cutting method (prescribed in JIS G 0551) based on a method described in Examples.

3) Fine Blanking Performance 3-1) Shear Surface Ratio of End Surface: 90% or More To ensure a predetermined fatigue life after heat treatment, it is desirable to suppress the fracture surface having a large surface roughness in the end surface as much as possible, and it is necessary to reduce the surface roughness of the end surface; thus, the shear surface ratio of the end surface is set to 90% or more. The shear surface ratio of the end surface is preferably 95% or more. Note that the shear surface ratio of the end surface is found by the following formula.

$$\text{Shear surface ratio of the end surface}=(\text{length of the shear surface}/\text{length of the entire end surface})\times 100$$

The length of the shear surface and the length of the entire end surface in the above formula are the length of the shear surface and the length of the entire end surface (the total length of the shear surface and the fracture surface), respectively, in the strip gauge direction at the center of the sheet width of a punched sheet having a length of 40 mm×a width of 60 mm and having four corners each with a curvature radius of 10 mm that is obtained by punching out a steel sheet by fine blanking processing using a die unit with the clearance between a blanking punch and a die set to 25 μm or less. Further, as the shear surface ratio of the end surface, the average value of the values calculated at the two centers of the sheet width existing in the punched sheet mentioned above is employed. Note that, in the case where fine blanking processing is performed using a die unit with the clearance between a blanking punch and a die set to 25 μm or less, also the die experiences large wear or the like in a place where the steel sheet and the die come into contact. A die unit with insufficient strength has insufficient wear resistance, and wears away early; thus, as the die unit, a die unit formed of an SKD steel material that can ensure a predetermined strength is preferably used. Further, the clearance between the blanking punch and the die of the die unit mentioned above is preferably 2 μm or more.

3-2) Arithmetic Average Roughness Ra of Shear Surface of End Surface: Less than 1.0 μm Since fine blanking processing is a processing method with a small clearance between a blanking punch and a die, a high load is applied to a die unit, particularly a high burden is applied to a blanking punch; thus, the life of the die unit is shorter than in ordinary punching. Also to prolong the life of the die unit, it is desirable that the surface roughness of the shear surface of the end surface be smaller; thus, the arithmetic average roughness Ra of the shear surface of the end surface is set to less than 1.0 μm. The arithmetic average roughness Ra of the shear surface of the end surface is preferably 0.8 μm or less, and more preferably 0.5 μm or less.

Note that the arithmetic average roughness Ra of the shear surface of the end surface is a value found by a method in which a steel sheet is subjected to fine blanking processing using a die unit with the clearance between a blanking punch and a die set to 25 μm or less, thus a sheet having a length of 40 mm×a width of 60 mm and having four corners each with a curvature radius of 10 mm is punched out, and a portion with a length of 5.0 mm in the sheet width direction is measured at the center of the strip gauge of the center of the sheet width of the punched sheet. Further, as the arithmetic average roughness Ra of the shear surface of the end surface, the average value of the values found respectively at the centers of the strip gauge of the two centers of the sheet width existing in the punched sheet mentioned above is employed.

4) Mechanical Properties

To improve the dimensional accuracy of a product such as a chain and the life (difficulty of wear) of a blanking die unit, also the control of mechanical properties is important in addition to, as described in the section of 2) above, the shape control of cementite for suppressing the formation of a fracture surface of the end surface during fine blanking processing. In the case where the hardness of the high-carbon cold rolled steel sheet is high, the area of the fracture surface tends to be increased in the end surface, and the abrasion of the die unit is made severe; thus, the hardness (cross-sectional hardness) of the high-carbon cold rolled steel sheet is preferably an HV 160 or less. Note that the cross-sectional hardness is found by a method described in Examples. Further, in the present description, although a description is not given up to the conditions of heat treatment performed after processing nor the hardness of the steel sheet after heat treatment, the high-carbon cold rolled steel sheet of the disclosed embodiments is used after subjected to heat treatment (quenching and tempering) after processing.

5) Manufacturing Method

A preferred method for manufacturing a high-carbon cold rolled steel sheet of the disclosed embodiments will now be described. Note that, throughout this disclosure, unless otherwise stated, temperatures such as finish rolling end temperature and coiling temperature refer to the surface temperature of a hot rolled steel sheet or the like, and can be measured with a radiation thermometer or the like. Further, unless otherwise stated, the average cooling rate refers to (cooling starting temperature−cooling stopping temperature)/(cooling time from cooling starting temperature to cooling stopping temperature).

Steel having a composition described in the section of 1) above is smelted by a known method such as a converter or an electric furnace, is cast to be fashioned into a cast piece by a known method such as continuous casting, is then directly heated or temporarily cooled and reheated, and is then subjected to hot rolling including rough rolling and finish rolling. First, the cast piece (a steel slab) is fashioned into a sheet bar by rough rolling. Note that the conditions of rough rolling do not particularly need to be prescribed, and rough rolling may be performed in accordance with a conventional method.

5-1) Finish Rolling End Temperature: Ar3 Transformation Point or Higher

After rough rolling is ended, finish rolling that is ended in the temperature region of the Ar3 transformation point or higher is performed. If the finish rolling end temperature is less than the $Ar_3$ transformation point, coarse ferrite grains are formed after hot rolling and after annealing (a first box-annealing and a second box-annealing), and fine blanking performance is considerably reduced. Thus, the finish rolling end temperature is set to the Ar3 transformation point or higher. Note that the upper limit of the finish rolling end temperature does not particularly need to be prescribed; however, to smoothly perform cooling after finish rolling, the upper limit of the finish rolling end temperature is preferably set to 1000° C. or less. Further, in the disclosed embodiments, the $Ar_3$ transformation point can be found with a Formaster. Specifically, when a columnar test piece with a diameter of 3 mm is temporarily heated from normal temperature to 900° C. and is cooled, the $Ar_3$ transformation point is a temperature corresponding to the first point of inflection of a thermal expansion curve at the time of cooling.

5-2) Temperature Region from Finish Rolling End Temperature to 660° C.: Average Cooling Rate: 30° C./s or More and 70° C./s or Less The way pearlite is formed after hot rolling varies with the average cooling rate in the temperature region from the finish rolling end temperature to 660° C. If the average cooling rate in the temperature region mentioned above is small, pearlite having a large lamellar spacing is produced, and predetermined cementite is not obtained after a first box-annealing, cold rolling, or a second box-annealing; thus, the average cooling rate in the temperature region mentioned above is set to 30° C./s or more. On the other hand, if the average cooling rate is too large, bainitic ferrite is obtained, and the hot rolled steel sheet itself is hardened. Even after undergoing subsequent steps, the steel sheet is hard, and a desired hardness is not obtained; thus, the average cooling rate in the temperature region mentioned above is set to 70° C./s or less. The average cooling rate in the temperature region mentioned above is preferably 65° C./s or less, and more preferably 60° C./s or less.

5-3) Coiling Temperature: 500° C. or More and 660° C. or Less

The hot rolled steel sheet after finish rolling is wound in a coil shape. If the coiling temperature is too high, the strength of the hot rolled steel sheet is reduced excessively, and the hot rolled steel sheet may be deformed due to the coil's own weight when wound in a coil shape; hence, this is not preferable in terms of operation. Thus, the upper limit of the coiling temperature is set to 660° C. On the other hand, if the coiling temperature is too low, the hot rolled steel sheet is hardened; hence, this is not preferable. Thus, the lower limit of the coiling temperature is set to 500° C. The coiling temperature is preferably 550° C. or more.

5-4) Temperature of First Box-Annealing: Annealing Temperature in Temperature Region of 650 to 720° C.

To obtain a desired strip gauge, it is necessary to perform cold rolling; and it is necessary to perform a first annealing so that the burden on the rolling mill is reduced to enhance cold rolling ability and a desired hardness is obtained in the steel serving as an end product. If the annealing temperature is less than 650° C., cold rolling ability is poor, and furthermore the promotion of the spheroidizing of cementite is slow and consequently hardening is made in the steel serving as an end product; thus, the annealing temperature of the first box-annealing is set to 650° C. or more. The annealing temperature of the first box-annealing is preferably 660° C. or more, and more preferably 670° C. or more. On the other hand, if the annealing temperature of the first box-annealing is more than 720° C., spheroidizing progresses excessively, and cementite is coarsened; thus, the annealing temperature of the first box-annealing is set to 720° C. or less. Further, the hold time at the annealing temperature mentioned above is preferably 20 h or more in terms of the progress of the spheroidizing of cementite. Further, the hold time at the annealing temperature mentioned above is preferably 40 h or less in terms of operationability.

5-5) Rolling Reduction Ratio of Cold Rolling: 20 to 50%

Cold rolling is needed in order to obtain a desired strip gauge and a predetermined ferrite grain diameter. If the rolling reduction ratio of cold rolling is less than 20%, the strip gauge of the hot rolled steel sheet needs to be reduced in order to obtain a desired strip gauge, and the control is difficult. Further, recrystallization is less likely to be made and recrystallization does not progress, and a desired hardness is less likely to be obtained. Thus, the rolling reduction ratio of cold rolling needs to be set to 20% or more. On the other hand, if the rolling reduction ratio of cold rolling is more than 50%, the thickness of the hot rolled steel sheet needs to be increased, and at the average cooling rate described above it is less likely that a microstructure uniform in the full thickness direction will be obtained. Further, the crystal grain size is reduced, and is made smaller than a predetermined ferrite grain diameter after recrystallization; thus, the rolling reduction ratio of cold rolling needs to be set to 50% or less.

5-6) Temperature of Second Box-Annealing: Annealing Temperature in Temperature Region of 650 to 720° C.

To obtain a desired hardness after cold rolling, a second annealing is needed. If the temperature of the second box-annealing is less than 650° C., recrystallization is less likely to progress, and a desired hardness is not obtained; thus, the temperature of the second box-annealing is set to 650° C. or more. The temperature of the second box-annealing is preferably 660° C. or more, and more preferably 670° C. or more. On the other hand, if the temperature of the second box-annealing is more than 720° C., a predetermined mean particle diameter of cementite is not obtained; thus, the temperature of the second box-annealing is set to 720° C. or less. Further, the hold time at the annealing temperature mentioned above is preferably 20 h or more in terms of obtaining a desired hardness. Further, the hold time at the annealing temperature mentioned above is preferably 40 h or less in terms of operationability.

After the second box-annealing, the high-carbon cold rolled steel sheet of the disclosed embodiments is, as necessary, subjected to temper rolling and subjected to treatment such as degreasing in accordance with a conventional method, and can be used as it is for fine blanking processing or the like. Fine blanking processing is performed in accordance with a conventional method, and is preferably performed under conditions such as selecting, for example, a clearance between a die and a punch, which is usually performed in order to obtain a good end surface, as appropriate. After processing is ended, heat treatment such as quenching, tempering, or austempering treatment may be performed in accordance with a conventional method; thereby, a desired hardness and desired fatigue strength are obtained.

In the high-carbon cold rolled steel sheet of the disclosed embodiments, although not particularly limited, the strip gauge is preferably 3.0 mm or less, and more preferably 2.5 mm or less. Further, although not particularly limited, the strip gauge is preferably 0.8 mm or more, and more preferably 1.2 mm or more.

EXAMPLES

Example 1

Steel having the chemical composition of each of steel numbers A to H shown in Table 1 was smelted and cast, and the resulting cast piece was subjected to finish rolling with the finish rolling end temperature set to the Ar3 transformation point or higher in accordance with the manufacturing condition shown in Table 2, was cooled at the average cooling rate shown in Table 2 through the temperature region from the finish rolling end temperature to 660° C., was coiled at the coiling temperature shown in Table 2, was pickled, was then subjected to a first box-annealing (spheroidizing annealing) under the condition shown in Table 2 in a nitrogen atmosphere (atmosphere gas: nitrogen), was then cold rolled at the rolling reduction ratio shown in Table 2, and was subjected to a second box-annealing under the condition shown in Table 2 in a nitrogen atmosphere; thus, a cold rolled steel sheet with a strip gauge of 2.0 mm was manufactured. The microstructure, hardness, and fine blanking performance of the cold rolled steel sheet thus manufactured were obtained in the following way. Note that the $Ar_3$ transformation point shown in Table 1 is one obtained by a Formaster.

[Hardness (Cross-Sectional Hardness)]

A sample was extracted from a central portion of the sheet width of the cold rolled steel sheet (original sheet) after the second box-annealing, the Vickers hardnesses (HV) of different 5 points were measured using a Vickers hardness meter (load: 1.0 kgf) in a position of ¼ of the strip gauge of a cross-sectional microstructure parallel to the rolling direction, and the average value of them was found.

[Microstructure]

For the microstructure of the cold rolled steel sheet after the second box-annealing, a sample extracted from a central portion of the sheet width was cut and polished, and was then subjected to nital etching, the microstructure of a position of ¼ of the strip gauge was observed using a scanning electron microscope, and the area fraction of each of ferrite and cementite was found. Further, the grain size of cementite was investigated in each of micrographs that were taken at a magnification of 2000 times in 5 places in a position of ¼ of the strip gauge. For the grain size of cementite, the long diameter and the short diameter were measured and converted to a circle-equivalent diameter, the average value of all cementite grains was found, and the average value was taken as the mean particle diameter of cementite. The average spacing between cementite grains was found by a method in which a cross section parallel to the rolling direction of a test piece extracted from the center of the sheet width of the steel sheet (a position of ¼ of the strip gauge) was observed with a scanning electron microscope at a magnification of 2000 times, cementite and portions other than cementite were binarized using an image analysis software application of GIMP, the individual spacings between cementite grains were found using an analysis software application of Image-J, and the sum total of them was divided by the number of spacings counted. Further, the method for finding the spheroidizing ratio of cementite is as follows. A cross section parallel to the rolling direction of a sample extracted from a central portion of the sheet width of the cold rolled steel sheet (a position of ¼ of the strip gauge) was observed with a scanning electron microscope at a magnification of 2000 times, cementite and portion other than cementite were binarized using an image analysis software application of GIMP, the area and the perimeter of each cementite grain were found using an analysis software application of Image-J, the circularity coefficient of each cementite grain was calculated by the following formula, and the average of the circularity coefficients was found and was taken as the spheroidizing ratio of cementite. Note that the mean particle diameter of ferrite was found using a cutting method (prescribed in JIS G 0551) in a cross section parallel to the rolling direction of a sample extracted from a central portion of the sheet width of the cold rolled steel sheet (a position of ¼ of the strip gauge).

$$\text{Circularity coefficient}=4\pi\cdot\text{area}/(\text{perimeter})^2$$

Note that, in all the samples shown in Table 2, the area fraction of ferrite in the microstructure is 85% or more.

[Fine Blanking Performance]

Fine blanking performance was investigated by the following method. A sheet having a length of 40 mm×a width of 60 mm and having four corners each with a curvature radius of 10 mm was punched out using a die unit made of an SKD and having a clearance of 10 μm, under conditions whereby the maximum load was 30 t. The center of the sheet width of the punched sheet was magnified 100 times by a microscope to measure the lengths in the strip gauge direction of the shear surface of the end surface and the entire end surface (the sum total of the shear surface and the fracture surface), and the shear surface ratio of the end surface was found by the following formula. Then, evaluation was made while a sample in which the shear surface ratio of the end surface was 95% or more was classified as ⊙ (particularly excellent), a sample with 90% or more and less than 95% was as ○ (excellent), and a sample with less than 90% was as x (poor). Note that, As the shear surface ratio of the end surface, the average value of the values calculated at the two centers of the sheet width existing in the punched sheet mentioned above was employed.

$$\text{Shear surface ratio of the end surface}=(\text{length of the shear surface}/\text{length of the entire end surface})\times 100$$

Furthermore, for the surface roughness of the shear surface of the end surface of the punched sheet, the arithmetic average roughness Ra was investigated in conformity with JIS 2001. Note that the arithmetic average roughness Ra of the shear surface of the end surface of the punched sheet is a value found by a method in which a portion with a length of 5.0 mm in the sheet width direction was measured at the center of the strip gauge of the center of the sheet width of the punched sheet. Further, as the arithmetic average roughness Ra of the shear surface of the end surface of the punched sheet, the average value of the values found at the centers of the strip gauge of the two centers of the sheet width existing in the punched sheet mentioned above was employed. Then, evaluation was made while a sample in which the arithmetic average roughness Ra of the shear surface of the end surface was less than 1.0 μm was classified as ○ (excellent) and a sample with 1.0 μm or more was as x (poor).

For fine blanking performance, a sample in which the shear surface ratio of the end surface was 95% or more and the arithmetic average roughness Ra of the shear surface was less than 1.0 μm was classified as an overall evaluation of ⊙ (particularly excellent), a sample in which the shear surface ratio of the end surface was 90% or more and less than 95% and the arithmetic average roughness Ra of the shear surface was less than 1.0 μm was as an overall evaluation of ○ (excellent), and other samples were as an overall evaluation of x (poor); the overall evaluations of ⊙ and ○ were classified as acceptance, and x was as failure. The results are shown in Table 2.

As is clear from Table 2, in the Examples, a high-carbon cold rolled steel sheet excellent in fine blanking performance that has a predetermined cementite mean particle diameter, a predetermined average spacing between cementite grains, a predetermined spheroidizing ratio of cementite, and a predetermined average size of ferrite grain was obtained in the steel of compositions containing 0.10% or more and less than 0.40% Cr. Further, the hardness (cross-sectional hardness) of the high-carbon cold rolled steel sheet mentioned above was an HV 160 or less. In contrast, desired fine blanking performance was not obtained in Comparative Examples, which were manufactured under conditions outside the ranges of the disclosed embodiments.

TABLE 1

| Steel | Chemical composition (mass %) | | | | | | | | $Ar_3$ transformation | |
|---|---|---|---|---|---|---|---|---|---|---|
| number | C | Si | Mn | P | S | sol.Al | N | Cr | point (° C.) | Remarks |
| A | 0.55 | 0.25 | 0.70 | 0.02 | 0.004 | 0.02 | 0.0100 | 0.15 | 770 | Example steel |
| B | 0.50 | 0.15 | 0.90 | 0.01 | 0.003 | 0.01 | 0.0090 | 0.20 | 755 | Example steel |
| C | 0.60 | 0.25 | 0.60 | 0.01 | 0.003 | 0.02 | 0.0100 | 0.10 | 760 | Example steel |
| D | 0.45 | 0.50 | 1.00 | 0.01 | 0.003 | 0.02 | 0.0070 | 0.10 | 780 | Example steel |

TABLE 1-continued

| Steel number | Chemical composition (mass %) C | Si | Mn | P | S | sol.Al | N | Cr | $Ar_3$ transformation point (° C.) | Remarks |
|---|---|---|---|---|---|---|---|---|---|---|
| E | 0.40 | 0.04 | 0.50 | 0.02 | 0.004 | 0.01 | 0.0100 | 0.04 | 786 | Comparative steel |
| F | 0.55 | 0.25 | 0.70 | 0.02 | 0.004 | 0.01 | 0.0100 | 0.40 | 763 | Comparative steel |
| G | 0.56 | 0.25 | 0.70 | 0.02 | 0.004 | 0.01 | 0.0100 | 0.35 | 762 | Example steel |
| H | 0.55 | 0.30 | 0.75 | 0.02 | 0.004 | 0.01 | 0.0100 | 0.05 | 768 | Comparative steel |

Note:

Underlined values fall outside the scope of the disclosed embodiments.

TABLE 2

| Sample No. | Steel No. | Hot rolling: Finish rolling end temperature (° C.) | Cooling: Average cooling rate*1 (° C./s) | Coiling: Coiling temperature (° C.) | First box-annealing: Annealing temperature—Hold time | Cold rolling: Rolling reduction ratio (%) | Second box-annealing: Annealing temperature—Hold time | Microstructure | Mean particle diameter of cementite (μm) |
|---|---|---|---|---|---|---|---|---|---|
| 1 | A | 830 | 50 | 610 | 710° C.—30 h | 40 | 710° C.—30 h | Ferrite + Cementite | 0.61 |
| 2 | A | 830 | 80 | 490 | 710° C.—30 h | 40 | 710° C.—30 h | Ferrite + Cementite | 0.39 |
| 3 | A | 830 | 50 | 610 | 640°C.—30h | 35 | 710° C.—30 h | Ferrite + Cementite | 0.35 |
| 4 | A | 830 | 50 | 610 | 710° C.—30 h | 70 | 710° C.—30 h | Ferrite + Cementite | 0.60 |
| 5 | B | 820 | 40 | 550 | 710° C.—30 h | 40 | 710° C.—30 h | Ferrite + Cementite | 0.56 |
| 6 | C | 860 | 40 | 660 | 710° C.—30 h | 35 | 710° C.—30 h | Ferrite + Cementite | 0.65 |
| 7 | D | 810 | 30 | 610 | 710° C.—30 h | 45 | 710° C.—30 h | Ferrite + Cementite | 0.59 |
| 8 | E | 830 | 50 | 580 | 710° C.—30 h | 40 | 710° C.—30 h | Ferrite + Cementite | 0.85 |
| 9 | F | 830 | 50 | 600 | 710° C.—30 h | 40 | 710° C.—30 h | Ferrite + Cementite | 0.35 |
| 10 | G | 830 | 60 | 610 | 710° C.—30 h | 40 | 710° C.—30 h | Ferrite + Cementite | 0.61 |
| 11 | H | 830 | 50 | 600 | 710° C.—30 h | 40 | 710° C.—30 h | Ferrite + Cementite | 0.90 |

| Sample No. | Average spacing between cementite grains (μm) | Spheroidizing ratio of cementite (%) | Average size of ferrite grain (μm) | Cross-sectional hardness (HV) | Fine blanking performance: Shear surface ratio*2 (%) | Arithmetic average roughness Ra*3 (μm) | Overall evaluation | Remarks |
|---|---|---|---|---|---|---|---|---|
| 1 | 3.7 | 83 | 5.9 | 148 | 97 | 0.35 | ⊙ | Example |
| 2 | 1.8 | 88 | 4.5 | 170 | 87 | 1.10 | X | Comparative example |
| 3 | 1.4 | 70 | 3.8 | 180 | 85 | 1.20 | X | Comparative example |
| 4 | 4.0 | 90 | 3.5 | 181 | 83 | 1.40 | X | Comparative example |
| 5 | 3.8 | 77 | 6.0 | 155 | 92 | 0.50 | ○ | Example |
| 6 | 3.2 | 89 | 6.5 | 145 | 98 | 0.25 | ⊙ | Example |
| 7 | 3.0 | 88 | 7.5 | 147 | 96 | 0.80 | ⊙ | Example |
| 8 | 6.0 | 95 | 4.5 | 144 | 85 | 1.20 | X | Comparative example |
| 9 | 1.3 | 70 | 5.0 | 159 | 88 | 1.20 | X | Comparative example |

TABLE 2-continued

| | | | | | | | | |
|---|---|---|---|---|---|---|---|---|
| 10 | 3.5 | 83 | 6.0 | 150 | 94 | 0.90 | ○ | Example |
| 11 | 6.5 | 90 | 5.0 | 159 | 88 | 1.20 | X | Comparative example |

Note:
Underlined values fall outside the scope of the disclosed embodiments.
*1Average cooling rate of temperature region from a finish rolling end temperature to 660° C.
*2Shear surface ratio of an end surface
*3Surface roughness of the shear surface of the end surface

The invention claimed is:

1. A high-carbon cold rolled steel sheet having a chemical composition comprising, by mass %:

C: 0.45 to 0.75%;
Si: 0.10 to 0.50%;
Mn: 0.50 to 1.00%;
P: 0.03% or less;
S: 0.01% or less;
sol. Al: 0.10% or less;
N: 0.0150% or less;
Cr: 0.10% or more and less than 0.40%; and
the balance including Fe and incidental impurities, wherein the steel sheet has a microstructure in which a mean particle diameter of cementite is in a range of 0.40 μm or more and 0.75 μm or less, an average spacing between cementite grains is in a range of 1.5 μm or more and 8.0 μm or less, a spheroidizing ratio of cementite is 75% or more, and an average size of ferrite grain is in a range of 4.0 μm or more and 10.0 μm or less, and a shear surface ratio of a punched end surface of the steel sheet after performing fine blanking processing using a die unit with a clearance between a blanking punch and a die set to 25 μm or less is 90% or more, and an arithmetic average roughness Ra of a shear surface of the punched end surface is less than 1.0 μm.

2. The high-carbon cold rolled steel sheet according to claim 1, wherein a cross-sectional hardness of the steel sheet is an HV 160 or less.

3. A method for manufacturing the high-carbon cold rolled steel sheet according to claim 1, the method comprising:

directly heating a cast piece having the chemical composition or temporarily cooling and reheating the cast piece, and then performing rough rolling;

performing, after the rough rolling is ended, finish rolling that is ended in a temperature range of an $Ar_3$ transformation point or higher to form a hot rolled steel sheet;

performing cooling at an average cooling rate in a range of 30° C./s or more and 70° C./s or less through a temperature range of a finish rolling end temperature to 660° C., coiling the hot rolled steel sheet at a temperature in a range of 500° C. or more and 660° C. or less, and, optionally, pickling the coiled hot rolled steel sheet; and then performing a first box-annealing of holding at an annealing temperature in a temperature range of 650 to 720° C., then performing cold rolling at a rolling reduction ratio in a range of 20 to 50%, and then performing a second box-annealing of holding at an annealing temperature in a temperature range of 650 to 720° C.

4. A method for manufacturing the high-carbon cold rolled steel sheet according to claim 2, the method comprising:

directly heating a cast piece having the chemical composition or temporarily cooling and reheating the cast piece, and then performing rough rolling;

performing, after the rough rolling is ended, finish rolling that is ended in a temperature range of an $Ar_3$ transformation point or higher to form a hot rolled steel sheet;

performing cooling at an average cooling rate in a range of 30° C./s or more and 70° C./s or less through a temperature range of a finish rolling end temperature to 660° C., coiling the hot rolled steel sheet at a temperature in a range of 500° C. or more and 660° C. or less, and, optionally, pickling the coiled hot rolled steel sheet; and then performing a first box-annealing of holding at an annealing temperature in a temperature range of 650 to 720° C., then performing cold rolling at a rolling reduction ratio in a range of 20 to 50%, and then performing a second box-annealing of holding at an annealing temperature in a temperature range of 650 to 720° C.

* * * * *